US006369763B1

(12) United States Patent
Norris et al.

(10) Patent No.: US 6,369,763 B1
(45) Date of Patent: Apr. 9, 2002

(54) RECONFIGURABLE PLASMA ANTENNA

(75) Inventors: Elwood G. Norris, Poway, CA (US); Ted Anderson, Niskayuna, NY (US); Igor Alexeff, Oak Ridge, TN (US)

(73) Assignee: ASI Technology Corporation, Henderson, NV (US)

( * ) Notice: Subject to any disclaimer, the term of this patent is extended or adjusted under 35 U.S.C. 154(b) by 0 days.

(21) Appl. No.: 09/543,445

(22) Filed: Apr. 5, 2000

(51) Int. Cl.[7] ..... H01Q 1/24
(52) U.S. Cl. ..... 343/701; 343/873
(58) Field of Search ..... 343/701, 702, 343/785, 872, 873

(56) References Cited

U.S. PATENT DOCUMENTS

| | | | | |
|---|---|---|---|---|
| 2,641,702 A | | 6/1953 | Cohen et al. | 250/33.63 |
| 2,643,297 A | | 6/1953 | Goldstein et al. | 178/44 |
| 3,155,924 A | | 11/1964 | Kaufman et al. | 333/7 |
| 3,404,403 A | | 10/1968 | Vallese et al. | 343/700 |
| 3,508,268 A | * | 4/1970 | Forman | 343/701 |
| 3,634,767 A | | 1/1972 | Roeder et al. | 325/363 |
| 3,719,829 A | | 3/1973 | Vaill | 307/149 |
| 3,779,864 A | | 12/1973 | Kaw et al. | 176/1 |
| 3,914,766 A | | 10/1975 | Moore | 343/701 |
| 4,001,834 A | | 1/1977 | Smith | 343/754 |
| 4,028,707 A | | 6/1977 | Young et al. | 343/719 |
| 4,062,010 A | | 12/1977 | Young et al. | 343/5 NA |
| 4,090,198 A | | 5/1978 | Canty et al. | 343/18 D |
| 4,347,512 A | | 8/1982 | Sweeney | 342/6 |
| 4,473,736 A | | 9/1984 | Bloyet et al. | 219/121 PM |
| 4,574,288 A | | 3/1986 | Sillard et al. | 343/781 P |
| 4,611,108 A | | 9/1986 | Leprince et al. | 219/121 PR |
| 4,989,013 A | | 1/1991 | Smith, II et al. | 343/721 |
| 5,175,560 A | | 12/1992 | Lucas et al. | 343/767 |
| 5,546,096 A | | 8/1996 | Wada | 343/771 |
| 5,594,456 A | | 1/1997 | Norris et al. | 343/701 |
| 5,963,169 A | | 10/1999 | Anderson et al. | 343/701 |
| 5,990,837 A | | 11/1999 | Norris et al. | 343/701 |
| 6,046,705 A | | 4/2000 | Anderson | 343/701 |

OTHER PUBLICATIONS

"A Theoretical and Experimental Study of a Microwave Plasma Closing Switch", Weng Lock Kang, Mark Rader and Igor Alexeff, UTK Plasma Science Laboratory, Department of Electrical and Computer Engineering, University of Tennessee, Knoxville, TN, p. 41P03.

* cited by examiner

*Primary Examiner*—Don Wong
*Assistant Examiner*—James Clinger
(74) *Attorney, Agent, or Firm*—Thorpe North & Western LLP

(57) ABSTRACT

The present invention is drawn toward a plasma antenna that is preferably reconfigurable, methods of generating plasma antennas, and a method of reconfiguring the radiation pattern of a plasma antenna. The plasma antenna is comprised of a) an enclosed chamber; b) a composition contained within the enclosed chamber capable of forming a plasma; c) at least three energizing points capable of forming electromagnetic contact with the composition; and d) an energy source coupled to the at three energizing points for developing at least one conductive path of plasma within the enclosed chamber. Preferably, a modifying mechanism may be utilized to reconfigure the conductive path.

38 Claims, 4 Drawing Sheets

RECONFIGURABLE PLASMA ANTENNA

FIELD OF THE INVENTION

The present invention is drawn toward a reconfigurable plasma antenna for radiating and receiving electromagnetic signal, methods for generating a plasma antenna, and a method for altering the radiation pattern of a plasma antenna. The device includes an enclosed chamber containing a composition capable of forming a plasma, at least three energizing points in electromagnetic contact with the composition, an energy source in electromagnetic contact with the energizing points for energizing the composition and selectively forming one or more conductive paths of plasma within the enclosed chamber, and preferably, a modifying mechanism to reconfigure the conductive path.

BACKGROUND OF THE INVENTION

Traditionally, antennas have been defined as metallic devices for radiating or receiving radio waves. Therefore, the paradigm for antenna design has traditionally been focused on antenna geometry, physical dimensions, material selection, electrical coupling configurations, multi-array design, and/or electromagnetic waveform characteristics such as transmission wavelength, transmission efficiency, transmission waveform reflection, etc. As such, technology has advanced to provide many unique antenna designs for applications ranging from general broadcast of RF signals to weapon systems of a highly complex nature.

Generally, an antenna is a conducting wire which is sized to emit radiation at one or more selected frequencies. To maximize effective radiation of such energy, the antenna is adjusted in length to correspond to a resonating multiplier of the wavelength of frequency to be transmitted. Accordingly, typical antenna configurations will be represented by quarter, half, and full wavelengths of the desired frequency.

Efficient transfer of RF energy is achieved when the maximum amount of signal strength sent to the antenna is expended into the propagated wave, and not wasted in antenna reflection. This efficient transfer occurs when the antenna is an appreciable fraction of transmitted frequency wavelength. The antenna will then resonate with RF radiation at some multiple of the length of the antenna. Due to this, metal antennas are somewhat limited in breadth as to the frequency bands that they may radiate or receive.

Recently, there has been interest in the use of plasmas as the conductor for antennas, as opposed to the use of metals. This interest is due in part to the fact that plasma antennas can be designed to be more flexible in use than traditional metal antennas. For example, radiated signal from a plasma antenna can be controlled by a number of factors including plasma density, tube geometry, gas type, applied magnetic field, and applied current. This concept has been described in U.S. Pat. No. 5,963,169 which is incorporated herein by reference. In that patent, a plasma antenna is disclosed that is electronically steerable and dynamically reconfigurable. This steerability and reconfigurability allows the antenna to be more efficient and operate in a wider band of frequencies.

Other exemplary art has been disclosed in U.S. Pat. Nos. 3,404,403 and 3,719,829 where the use of a plasma column formed in air by laser radiation as the antenna transmission element is disclosed. Additionally, U.S. Pat. No. 3,914,766 discloses a pulsating plasma antenna which has a cylindrical plasma column and a pair of field exciter members parallel to the column. The location and shape of the exciters, the cylindrical configuration, and the natural resonant frequency of the plasma column all provide enhancement of the natural resonant frequency of the plasma column and energy transfer. Additionally, these factors act to stabilize the motion of the plasma, preventing unwanted oscillations and unwanted plasma waves from destroying the plasma confinement.

U.S. Pat. Nos. 5,594,456 and 5,990,837, both of which are incorporated herein by reference, disclose an antenna device for transmitting a short pulse duration signal of predetermined radio frequency. The antenna device includes a gas filled tube, a voltage source for developing an electrically conductive path along a length of the tube which corresponds to a resonant wavelength multiple of the predetermined radio frequency, and a signal transmission source coupled to the tube which supplies the radio frequency signal. One application of this antenna design is to transmit short pulse duration signal in a manner that eliminates a trailing antenna resonance signal.

Due to the dynamic reconfigurability of plasma antennas, some limitations previously known to exist with metal antennas are beginning to be removed. However, in order to more fully tap into the reconfigurability of plasma antennas, it would be useful to provide a plasma antenna having three or more energizing points that is reconfigurable with respect to signal rate, location of feeds, types of feeds, timing of signal, quantity of feeds energized, intensity of signal, shape of enclosure, density of plasma, and type of composition used.

OBJECTS AND SUMMARY OF THE INVENTION

It is an object of the present invention to provide a plasma antenna that may be controlled by at least three energizing points in electromagnetic contact with a composition capable of forming a plasma to selectively ionize the composition, or portions thereof, within the enclosed chamber.

It is another object of the invention to provide a reconfigurable plasma antenna wherein the radiation pattern may be altered by altering one or more of several variables including signal rate, location of feeds, types of feeds, timing of signal, quantity of feeds energized, intensity of signal, shape of enclosure, density of plasma, and type of composition used to form the plasma, to name a few.

It is another object of the present invention to provide a single plasma antenna that may be used in the place of several conventional antennas.

These and other objects may be accomplished by the plasma antenna and methods of the present invention. The plasma antenna is comprised of a) an enclosed chamber; b) a composition contained within the enclosed chamber capable of forming a plasma; c) at least three energizing points capable of forming electromagnetic contact with the composition; and d) an energy source coupled to the at three energizing points for developing at least one conductive path of plasma within the enclosed chamber. Preferably, the plasma antenna may further comprise a modifying mechanism to reconfigure the conductive path. In the most simple embodiment, any combination of three energizing points may be energized, i.e., any single energizing point, any two energizing points, or all three energizing points.

BRIEF DESCRIPTION OF THE DRAWINGS

A more complete understanding of the invention will be readily appreciated by reference to the following detailed description when considered in conjunction with the accompanying drawings. Corresponding reference characters indicate corresponding parts throughout the several embodiments shown.

DETAILED DESCRIPTION OF THE INVENTION

Before the present invention is disclosed and described, it is to be understood that this invention is not limited to the particular process steps and materials disclosed herein as such process steps and materials may vary to some degree. It is also to be understood that the terminology used herein is used for the purpose of describing particular embodiments only and is not intended to be limiting as the scope of the present invention will be limited only by the appended claims and equivalents thereof.

It must be noted that, as used in this specification and the appended claims, singular forms of "a," "an," and "the" include plural referents unless the content clearly dictates otherwise.

"Energizing point" is meant to include any electromagnetic interface of any size or dimension between the energy source and the composition for the purpose of forming one or more plasma conductive paths.

Figure 1:
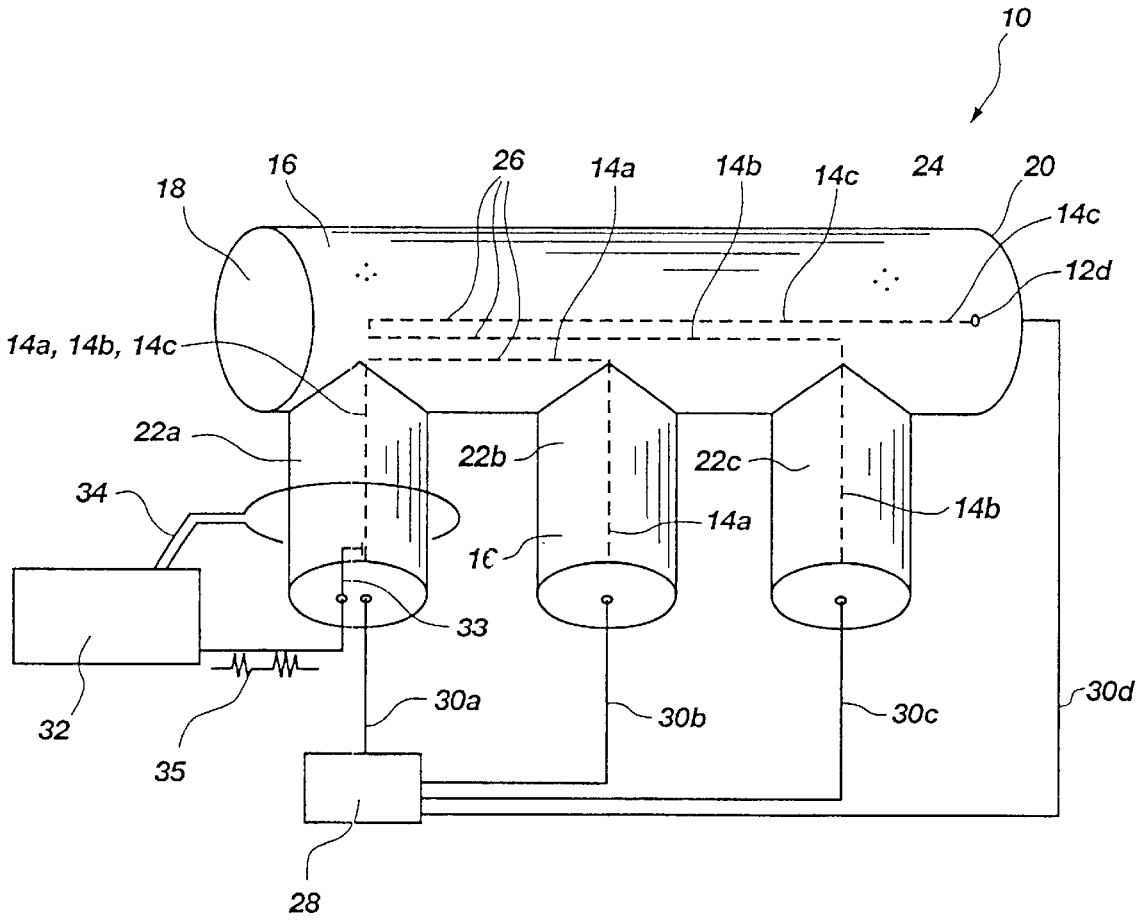
FIG. 1 is a schematic drawing of a pronged plasma antenna having four energizing points and several possible conductive paths.

Referring to FIG. 1, a schematic drawing of a pronged plasma antenna 10 having four energizing points 12*a*, 12*b*, 12*c*, 12*d* and several possible conductive paths 14*a*, 14*b*, 14*c* are shown. In this embodiment, though only three conductive paths 14*a*, 14*b*, 14*c* are shown, there are other possible conductive paths or combinations of conductive paths that may be utilized, e.g., a conductive path between energizing point 12*b* and energizing point 12*c* as well as other conductive paths ascertainable by those skilled in the art.

Specifically, the pronged plasma antenna 10 includes a pronged enclosed chamber 16 having a proximal end 18, a distal end 20, and three prongs 22*a*, 22*b*, 22*c*. A composition 24 is contained within the enclosed chamber 16 that is capable of forming one ore more conductive paths 14*a*, 14*b*, 14*c* of plasma 26. An energy source 28 or other means is used to form one or more conductive paths 14*a*, 14*b*, 14*c* of plasma 26 which preferably corresponds to a resonant wavelength multiple of predetermined electromagnetic wave frequency. The energy source 28 is electromagnetically connected to the energizing points 12*a*, 12*b*, 12*c*, 12*d* by energizing leads 30*a*, 30*b*, 30*c*, 30*d* respectively.

The composition that may be used to form the plasma conductive paths 14*a*, 14*b*, 14*c* is preferably a gas selected from the group consisting of neon, xenon, argon, krypton, hydrogen, helium, mercury vapor, and mixtures thereof.

The energizing leads 30*a*, 30*b*, 30*c*, 30*d* leading to the energizing points 12*a*, 12*b*, 12*c*, 12*d* from the energy source 28 may be in the form of electrodes, fiber optics, high frequency signal, lasers, RF heating, electromagnetic couplers, and/or other mediums known by those skilled in the art. Whether or not such a coupler is used, one or more conductive path 14*a*, 14*b*, 14*c* is preferably created by a voltage differential between two or more of the energizing points. Thus, the composition 24 is activated and forms one or more ionized conductive paths 14*a*, 14*b*, 14*c* and permits rapid initiation and termination of the conductive paths 14*a*, 14*b*, 14*c*. During ionization of the composition 24, one or more conductive paths 14*a*, 14*b*, 14*c* may become an effective antenna element. When the conductive paths 14*a*, 14*b*, 14*c* are terminated by cutting off the energy source 28, the antenna ceases to exist.

A signal generator 32 is also electromagnetically coupled to the plasma conductive paths 14*a*, 14*b*, 14*c* for supplying an electromagnetic frequency signal 35 to one or more conductive paths 14*a*, 14*b*, 14*c* for antenna transmission. The signal produced by the signal generator 32 must be put in electromagnetic contact with one or more conductive paths 14*a*, 14*b*, 14*c*. This may be accomplished by feeding the signal in close proximity to at least one of the conductive paths 14*a*, 14*b*, 14*c*, or by the use of a signal coupler 33 or other mechanism know by those skilled in the art. If some other conductive path (not shown) is utilized other than one of those shown, then the signal generator 32 should be coupled to a different location such that the signal reaches the conductive path. For example, if a conductive path (not shown) is desired to be generated between energizing point 12*b* and energizing point 12*d*, then the signal generator 32 should be reconfigured such that the signal is in electromagnetic contact with the conductive path (not shown) that exists between these two energizing points 12*b*, 12*d*. The signal generator may be configured to produce radio frequency such as EHF, SHF, UHF, VHF, HF, and MF including AM or FM signals and digital spread spectrum signals, lower frequency signals such as LF, VLF, ULF, SLF, and ELF, and other known electromagnetic signals as would be functional with the present invention.

A spike voltage or other trigger mechanism 34 may be electromagnetically coupled to the composition 24 for initiating one or more of the conductive paths 14*a*, 14*b*, 14*c*. This may be used where the initial threshold voltage to develop electron flow is higher than the voltage required to maintain such a path. This trigger voltage can be supplied by a capacitor or other form of pulse generator. Where the conductive paths 14*a*, 14*b*, 14*c* within the enclosed chamber 16 are sufficiently short and the respective initiating and maintenance voltages for conductivity are approximately the same, voltage levels supplied by the electromagnetic wave frequency to be transmitted may be sufficient to create one or more conductive path 14*a*, 14*b*, 14*c* from the composition 24 and transmit the signal without the need for separate spike voltage or triggering mechanism 34.

The triggering mechanism 34, the signal generator 32, and the energy source may also include one or more timing circuits (not shown) for correlating the electromagnetic wave frequency to be transmitted with one or more conductive path 14*a*, 14*b*, 14*c* that are present within the enclosed chamber 16. The timing circuits (not shown) may also be used to correlate other aspects of the invention as would be recognized by one having skill in the art.

Figure 2:
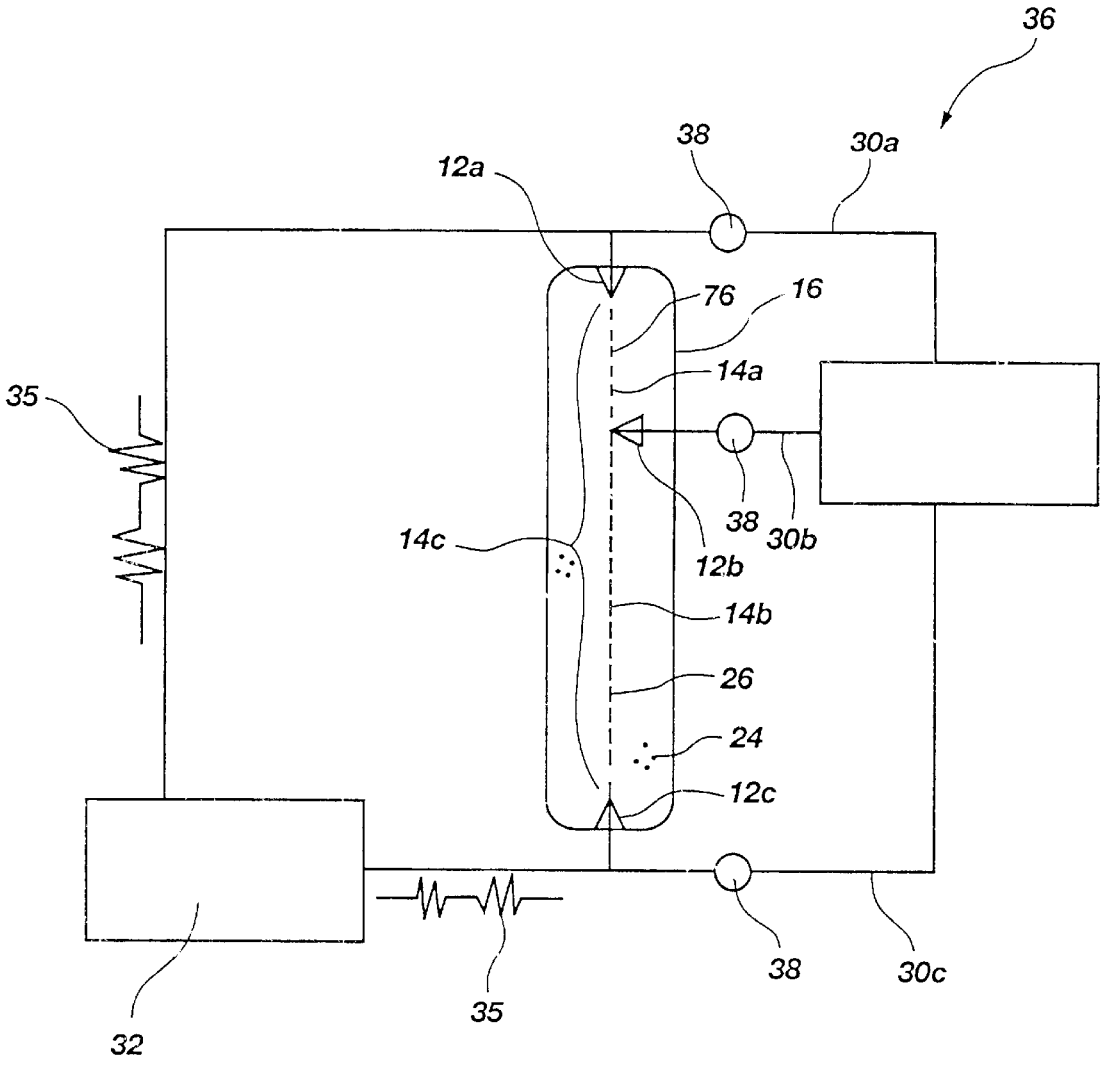
FIG. 2 is a schematic drawing of a linear plasma antenna having three energizing points.

Referring to FIG. 2, a schematic drawing of a linear plasma antenna 36 having three energizing points 12*a*, 12*b*, 12*c*, and three possible conductive paths 14*a*, 14*b*, 14*c* are shown. Energizing point 12*b* is off-set from the center to provide conductive paths 14*a*, 14*b*, 14*c* of three different lengths, thus giving the antenna more versatility. Conductive path 14*a* is represented by a dotted line, conductive path 14*b* is represented by a dashed line, and conductive path 14*c* is a combination of conductive path 14*a* and conductive path

14*b*. In this embodiment, to energize conductive path 14*a*, energizing points 12*a* and 12*b* are activated. To energize conductive path 14*b*, energizing points 12*b* and 12*c* are activated. To energize conductive path 14*c*, energizing points 12*a* and 12*c* are activated.

The linear plasma antenna 36 is comprised of tube shaped enclosed chamber 16 and a composition 24 contained within the enclosed chamber 16 that is capable of forming a conductive path 14*a*, 14*b*, 14*c* of plasma 26. An energy source 28 or other means is used to form the conductive path 14*a*, 14*b*, 14*c* of plasma 26 which preferably corresponds to a resonant wavelength multiple of predetermined electromagnetic wave frequency. The energy source 28 is electromagnetically connected to the energizing points 12*a*, 12*b*, 12*c* by energizing leads 30*a*, 30*b*, 30*c* respectively.

As in FIG. 1, the composition that may be used to form the plasma conductive paths 14*a*, 14*b*, 14*c* is preferably a gas selected from the group consisting of neon, xenon, argon, krypton, hydrogen, helium, mercury vapor, and mixtures thereof. Additionally, the energizing leads 30*a*, 30*b*, 30*c*, 30*d* leading to the energizing points 12*a*, 12*b*, 12*c* may be in the form of electrodes, fiber optics, high frequency signal, lasers, RF heating, electromagnetic couplers, and/or other mediums known by those skilled in the art. A conductive path 14*a*, 14*b*, 14*c* is preferably created by a voltage differential between two of the energizing points. Thus, the composition 24 is activated and forms ionized conductive paths 14*a*, 14*b*, 14*c* and permits rapid initiation and termination of each conductive path 14*a*, 14*b*, 14*c*. During ionization of the composition 24, the activated conductive paths 14*a*, 14*b*, 14*c* may become an effective antenna element. When the selected conductive path 14*a*, 14*b*, 14*c* is terminated by cutting off the energy source 28, the antenna ceases to exist.

A signal generator 32 is also electromagnetically coupled to the plasma conductive paths 14*a*, 14*b*, 14*c* for supplying an electromagnetic frequency signal 35 to one or more conductive paths 14*a*, 14*b*, 14*c* for antenna transmission. The signal generator may be configured to produce radio frequency such as EHF, SHF, UHF, VHF, HF, and MF including AM or FM signals and digital spread spectrum signals, lower frequency signals such as LF, VLF, ULF, SLF, and ELF, and other known electromagnetic signals.

The energy source 28 electromagnetically coupled to the energizing points 12*a*, 12*b*, 12*c* can be any voltage source capable of establishing the threshold voltage required to maintain a conductive state within the enclosed chamber 16. Decouplers 38 such as inductors or chokes may optionally be positioned electrically between the energizing points 12*a*, 12*b*, 12*c* and the energy source 28 to prevent undesired electromagnetic frequency signals of the energy source 28 from being coupled into and corrupting the conductive paths 14*a*, 14*b*, 14*c* with spurious signals. Those skilled in the art will be aware of numerous other decoupling devices and circuits which could be implemented for this or other similar purposes. Additionally, as in FIG. 1, a spike voltage or other trigger mechanism (not shown) as well as timing circuits (not shown) may also be utilized as previously described.

Figure 3:
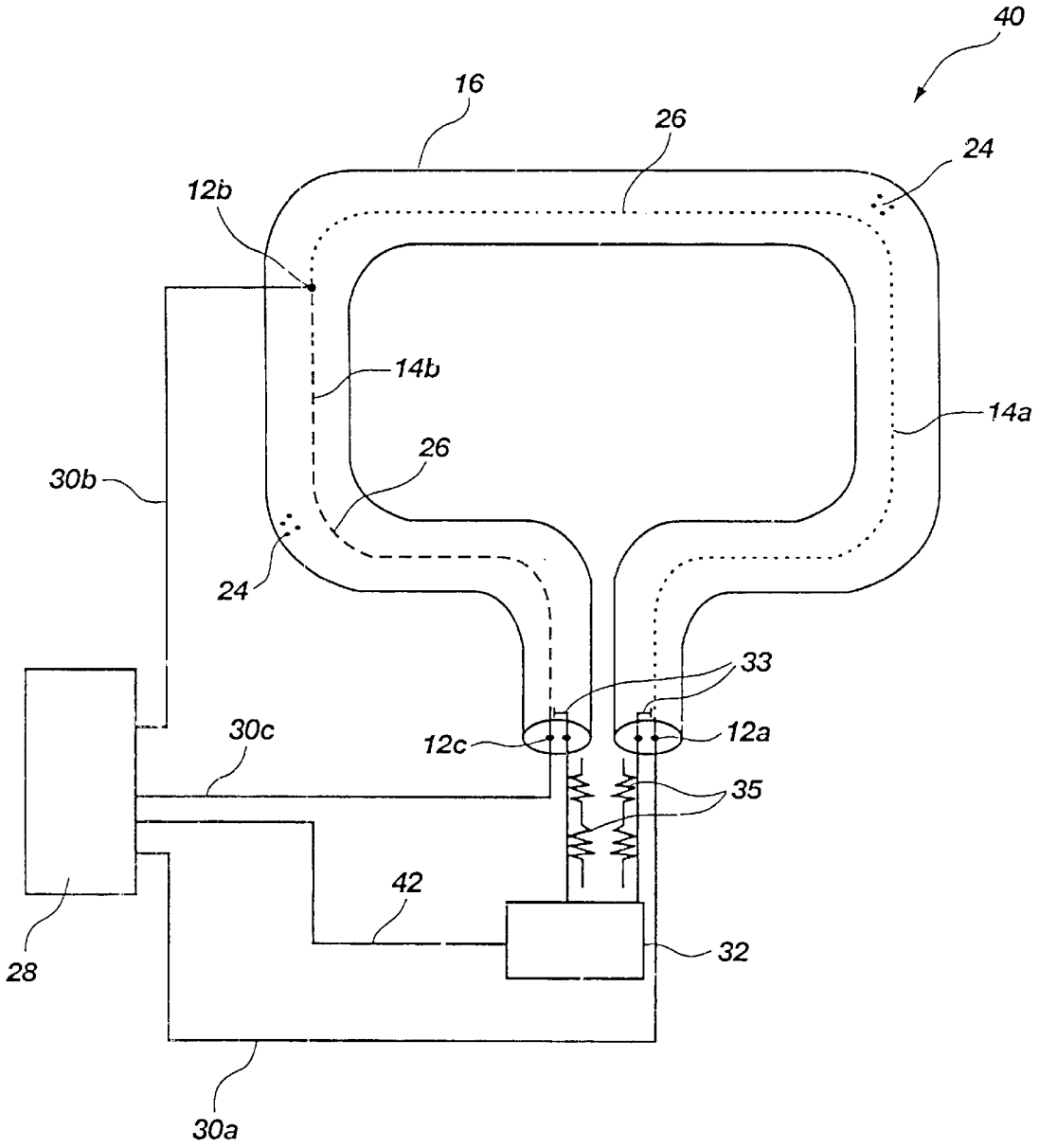
FIG. 3 is a schematic drawing of a looped plasma antenna having three energizing points.

Referring to FIG. 3, a schematic drawing of a looped plasma antenna 40 having three energizing points 12*a*, 12*b*, 12*c*, and three possible conductive paths 14*a*, 14*b*, 14*c* are shown. Conductive path 14*a* is represented by a dotted line, conductive path 14*b* is represented by a dashed line, and conductive path 14*c* is a combination of conductive path 14*a* and conductive path 14*b*. In this embodiment, to energize conductive path 14*a*, energizing points 12*a* and 12*b* are activated. To energize conductive path 14*b*, energizing points 12*b* and 12*c* are activated. To energize conductive path 14*c*, energizing points 12*a* and 12*c* are activated.

The looped plasma antenna 36 is similar to the linear plasma antenna (not shown) except that it is configured differently. An energy source 28 or other means is used to form one or more conductive paths 14*a*, 14*b*, 14*c* of plasma 26 which preferably corresponds to a resonant wavelength multiple of predetermined electromagnetic wave frequency. The energy source 28 is electromagnetically connected to the energizing points 12*a*, 12*b*, 12*c* by energizing leads 30*a*, 30*b*, 30*c* respectively.

As discussed previously, the composition that may be used to form the plasma conductive paths 14*a*, 14*b*, 14*c* is preferably a gas selected from the group consisting of neon, xenon, argon, krypton, hydrogen, helium, mercury vapor, and mixtures thereof. Additionally, the energizing leads 30*a*, 30*b*, 30*c*, 30*d* leading to the energizing points 12*a*, 12*b*, 12*c* may be in the form of electrodes, fiber optics, high frequency signal, lasers, RF heating, electromagnetic couplers, and/or other mediums known by those skilled in the art. A conductive path 14*a*, 14*b*, 14*c* is preferably created by a voltage differential between two of the energizing points. Thus, the composition 24 is activated and forms an ionized conductive paths 14*a*, 14*b*, or 14*c* and permits rapid initiation and termination of each conductive path 14*a*, 14*b*, 14*c*. During ionization of the composition 24, the activated conductive paths 14*a*, 14*b*, 14*c* may become an effective antenna element. When the selected conductive path 14*a*, 14*b*, 14*c* is terminated by cutting off the energy source 28, the antenna ceases to exist.

A signal generator 32 is also electromagnetically coupled to the plasma conductive paths 14*a*, 14*b*, 14*c* such that the electromagnetic frequency signal 35 is supplied to one or more conductive paths 14*a*, 14*b*, 14*c* for antenna transmission. The signal generator may be configured to produce radio frequency such as EHF, SHF, UHF, VHF, HF, and MF including AM or FM signals and digital spread spectrum signals, lower frequency signals such as LF, VLF, ULF, SLF, and ELF, and other known electromagnetic signals.

In this embodiment, timing coupler 42 is shown to facilitate communication between the signal generator 32 and the energy source 28. Timing circuitry (not shown) should be present, usually within the energy source 28 and/or the signal generator, in order for the communication to timed appropriately.

Figure 4:
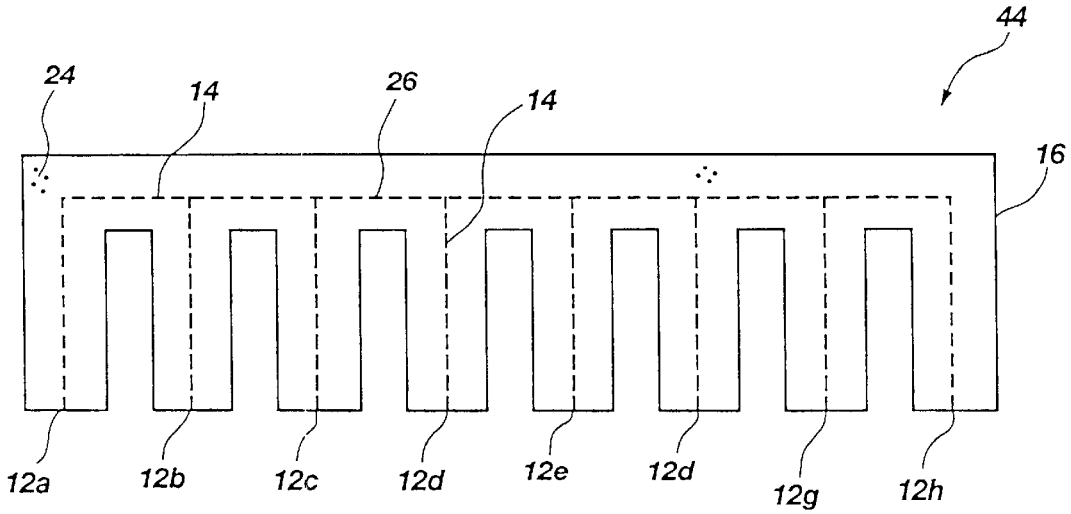
FIG. 4 is a schematic drawing of a pronged plasma antenna having eight energizing points, one at the end of each prong.

Referring to FIG. 4, a schematic drawing of a pronged plasma antenna 44 having eight energizing points 12*a–h* and several possible conductive paths 14 and combinations of conductive paths 14 are shown. In this embodiment, there are twenty eight possible paths 14 where only two energizing points 12*a–h* are being utilized. Additionally, various combinations utilizing three to eight energizing points 12*a–h* increases the possible combinations of conductive paths greatly. This, coupled with the fact that each energizing point 12*a–h* may be energized at different intensities and for different periods of time, provides an antenna element that is dynamically reconfigurable and may be used for multiple applications. In fact, multiple applications may be carried out simultaneously with such a configuration.

Though the energy source, signal generator, and other elements previously described are not shown, the same principles apply to this structure. For example, as discussed previously, the composition that may be used to form the plasma conductive paths 14 is preferably a gas selected from the group consisting of neon, xenon, argon, krypton, hydrogen, helium, mercury vapor, and mixtures thereof. Additionally, the energy source may energize the composition to form the conductive paths through electrodes, fiber optics, high frequency signal, lasers, RF heating, electromagnetic couplers, and/or other mediums known by those skilled in the art.

Figure 5:
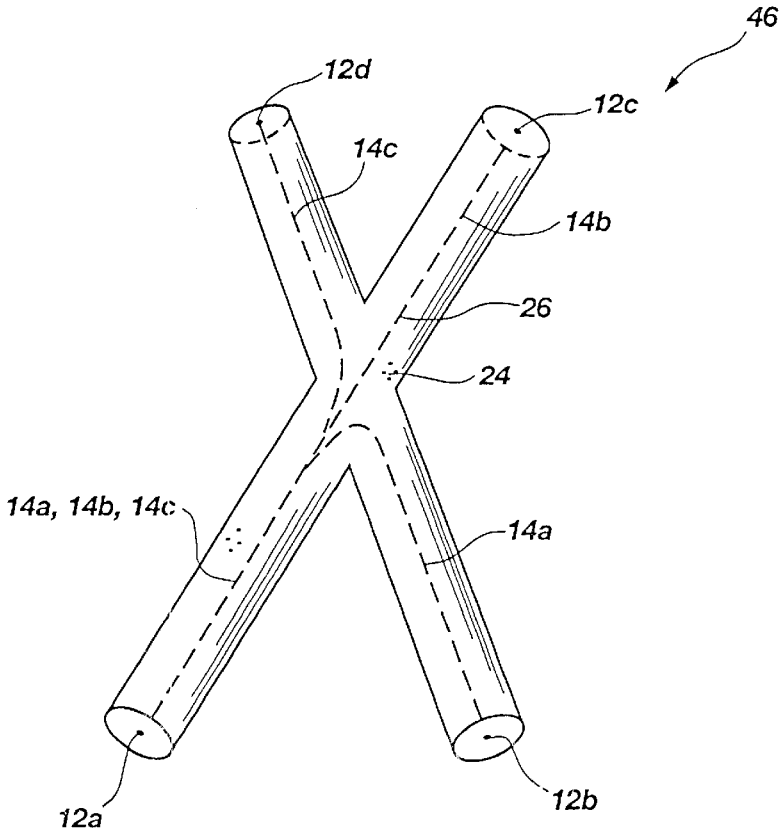
FIG. 5 is a schematic drawing of a radiant-shaped plasma antenna having four tubes extending from a common center and showing three possible conductive paths and combinations of paths.

Referring to FIG. 5, a schematic drawing of a cross-shaped plasma antenna 46 having four energizing points 12*a*, 12*b*, 12*c*, 12*d* and three conductive paths 14*a*, 14*b*, 14*c* and combinations thereof are shown. In this particular embodiment, there are three possible paths 14*a*, 14*b*, 14*c* where energizing point 12*a* and a second energizing point 12*b*, 12*c*, 12*d* are utilized. However, one skilled in the art will recognize that any single energizing point 12*a*, 12*b*, 12*c*, 12*d*, all four energizing points 12*a*, 12*b*, 12*c*, 12*d*, or any combination of two or three energizing points 12*a*, 12*b*, 12*c*, 12*d* may be used to create alternative conductive paths 14. This, coupled with the fact that each energizing point 12*a*, 12*b*, 12*c*, 12*d* may be energized at different intensities and for different periods of time, provides an antenna element that is dynamically reconfigurable and may be used for multiple applications.

Though the energy source, signal generator, and other elements previously described are not shown, the same principles apply to this structure as applied to the previous structures. For example, as discussed previously, the composition 24 that may be used to form the plasma 26 conductive paths 14 is preferably a gas selected from the group consisting of neon, xenon, argon, krypton, hydrogen, helium, mercury vapor, and mixtures thereof. Additionally, the energy source (not shown) may energize the composition 24 to form the conductive paths 14 through electrodes, fiber optics, high frequency signal, lasers, RF heating, and/or other mediums known by those skilled in the art. Additionally, with regard to the energy source used form the plasma, a coupler (or the like) such as that described in U.S. patent application entitled RECONFIGURABLE ELECTROMAGNETIC WAVEGUIDE which is filed herewith and incorporated herein by reference, may also be used to both energize the composition and provide signal to the plasma antenna (hereinafter referred to as Attorney Docket No. "T8414"). Such a coupler may be used in any of the embodiments described herein for one or all of the energizing points.

With these figures in mind, a plasma antenna comprising a) an enclosed chamber; b) a composition contained within the enclosed chamber capable of forming a plasma; c) at least three energizing points capable of forming electromagnetic contact with the composition; and d) an energy source coupled to the at three energizing points for developing at least one conductive path of plasma within the enclosed chamber. Preferably, a modifying mechanism to reconfigure the conductive path is also disclosed and described.

The enclosed chamber should preferably be comprised of a non-conductive, and optionally, dielectric material. If the enclosed chamber is an elongated tube, then a linear or looped tube is preferred. However, the elongated tube may be configured in any manner that is functional for a specific purpose. Other preferred structures for the enclosed chamber include pronged or radiant enclosures. Particularly, with a pronged structure, each energizing point may be somewhat isolated from other energizing points, making very specific conductive paths between energizing points more defined. The same is true for other structures where the energizing points are somewhat isolated such as tubes that radiate from a common center, e.g., cross-shaped or other radiant shapes, and having energizing points configured at or within each appendage.

In a preferred embodiment, at least one conductive path is less than the length of the enclosed chamber. In another preferred embodiment, at least two conductive paths of plasma are formed within the enclosed chamber such that multiple densities of plasma may exist within the same enclosed chamber. This provides unique antenna properties that are difficult or impossible to obtain using metals.

As stated previously, the composition is preferably a gas that is capable of forming a plasma, preferably by ionization of the gas. Exemplary gasses for this purpose include neon, xenon, argon, krypton, hydrogen, helium, mercury vapor, and combinations thereof.

Though it is possible that one energizing point be used to form the plasma conductive path, it is preferred that at least two energizing points are utilized for this purpose. The use of three, four, or even more energized energizing points is also preferred. Additionally, though the invention requires that at least three energizing points be electromagnetically coupled to the composition to form the conductive paths, from 3 to 12 energizing points are preferred for a single enclosed chamber. However, it is important to note that this preferred range is intended to in no way limit the number of energizing points that may be used in a single enclosed chamber. For example, if fiber optics are used to energize the composition to form the plasma, then many more energizing points could be practically used.

In many circumstances, the composition within the enclosed chamber is only ionized to form a plasma conductive path within a portion of the enclosed chamber. As such, any composition that is not aligned with the path, i.e., between the energized energizing points, is not energized to form a plasma. As such, selective ionization within a single chamber through the use of strategically placed energizing points becomes useful in providing maximum reconfigurability. Preferably, reconfigurability may be accomplished by the use of a modifying mechanism.

The modifying mechanism may be designed to alter any of a number of variables present on the plasma antenna. For example, the modifying mechanism can act to control the energizing points, e.g., when energizing points are energized, which energizing points are energized, the amount of voltage applied, the intensity of signal applied, and other known variables. In many circumstances, the energizing points will alter the plasma conductive path or plasma density in general. However, other modifying mechanisms may be used such as those which alter the pressure of the composition within the enclosed chamber which also may be used to reconfigure the plasma antenna properties. For example, the modifying mechanism may control when and where transition between the composition and the plasma occurs. Such a mechanism may occur by increased or decreased composition pressure to alter the geometry of the enclosure. If the desire is to avoid altering the geometry, pressure changes without deformation of the enclosure may also create enhance reconfigurability. Specifically, by decreasing the pressure of the composition within the enclosed chamber, ionization within the chamber may increase. Conversely, by increasing the pressure of the composition, ionization may decrease. Additionally, the modifying mechanism may be a mechanism as simple as changing the placement of energizing points. These and other modifying mediums or mechanisms apparent to those skilled in the art may be used to reconfigure the plasma based antennas of the present invention.

The plasma antenna elements of the present invention, in some ways, are like standard antenna elements. These antennas do not transmit electromagnetic signal without an RF or other emitting signal or source. Therefore, for practical purposes, the plasma antennas are generally electromagnetically coupled to a signal generator. The emitting signal to be transmitted is preferably RF signal, but can also be any electromagnetic signal known by those skilled in the art. Though the emitting source source is sometimes separate from the energy source used to form the plasma, a single device, such as an electromagnetic coupler, may be used to carry out both purposes.

A significant advantage of the plasma antennas of the present invention over the prior art includes the antennas ability to be adapted to different lengths and geometric configurations. Tubes of gas are created in many shapes and are limited only by the dynamics of the material used for construction. In addition, tube lengths or placement of energizing points can be tailored to any desired harmonic multiplier or the plasma density may be modified to alter the properties of the conductive path. In this way, the antenna may be tuned to the wavelength to be broadcast or receive. However, more importantly with respect to the present invention, by providing several energizing points, many more radiation patterns are possible without changing the geometry of the enclosed chamber. Additionally, rather than altering the geometry of the enclosed chamber, it is also possible to alter antenna by altering the natural plasma frequency. For example, a more dense plasma would create properties such as those found in a traveling wave antenna and a less dense plasma would create properties such as those found in a standing wave antenna. In other words, with plasma, the geometry of the enclosed chamber and/or the capacitance and inductance of the plasma may be altered to achieve a desired result. Conversely, with a metal antenna, only the antenna geometry may be changed.

As discussed, it is preferred that the enclosed chamber is constructed of one or more non-conductive materials so that the chamber does not electromagnetically interfere with the plasma antenna field that is generated. Additionally, the energizing points may preferably be energized by fiber optics or the like such that there are no metal electrodes present to interfere with the antenna signal. An additional advantage to using all non-metallic materials includes the ability for the antenna to be invisible to radar when not transmitting and invisible to radar at frequencies not transmitting.

There are many applications of use for the plasma antennas of the present invention. For example, these antennas as well as other plasma antennas known in the art could be arranged, preferably in close proximity to one another, to form plasma antenna arrays. By utilizing a plasma antenna array rather than a single antenna, a better electromagnetic image may be obtained. For example, many dipoles, helicals, spirals, reflectors, etc. could be pointed or positioned in a given direction to provide a more directional beam or another desired result. With such an arrangement, any number of the antennas could be turned on or off providing the ability to generate a highly reconfigurable radiation pattern. Additionally, by de-energizing the plasma within a chamber, the de-energized antennas would not interfere with the operating antennas. Such a benefit is not possible with the use of metal antennas in an array because metal antennas in close proximity tend to interfere with one another.

Several methods are also disclosed for generating a plasma antenna. The first method comprises a) defining a first conductive path of plasma within an enclosed chamber; b) defining a second conductive path of plasma within the same enclosed chamber; and c) selectively energizing at least one of the first and second conductive paths. In this method, the first conductive path or the second conductive path may be individually energized. However, the first conductive path and the second conductive path may also be simultaneously energized. This provides for the possibility of multiple plasma densities or multiple antennas within the same enclosed chamber. There may also be more than two possible conductive paths available for energizing, depending on the configuration placement of the energizing points. Often, the length of the conductive paths are less than the length of the enclosed chamber if an enclosed chamber is used as described above.

A second method of generating a plasma antenna is disclosed comprising the steps of a) applying at least three energizing points in electromagnetic communication with a composition capable of forming a plasma; and b) energizing at least one energizing point such that a conductive path of plasma is formed that is capable of receiving or transmitting electromagnetic waves. If only one energizing point is utilized, it is preferred that the path be created between the energizing point and an energy sink. However, it is preferred that at least two energizing points be energized. Though at least three energizing points are required as described above, from 3 to 12 energizing points are preferred. Additionally, the energizing points may be energized by a common energy source or by multiple energy sources.

A method of reconfiguring a plasma antenna to alter the radiation pattern is also disclosed. The first step includes providing a plasma antenna comprised of an enclosed chamber, a composition contained within the enclosed chamber capable of forming a plasma wherein at least a portion of the composition is energized to form a plasma conductive path, at least three energizing points in electromagnetic contact with the composition, an energy source electromagnetically coupled to the energizing points wherein at least one energizing point is energized by the energy source to form the plasma conductive path, and a signal generator electromagnetically coupled to the plasma conductive path such that an emitting signal is transferred from the signal generator to the plasma conductive path. Next, the energizing point or combination of points being energized is altered by the energy source, thereby altering the plasma conductive path carrying the emitting signal.

Based upon this disclosure, it will be understood that many additional changes in the details, materials, steps and arrangement of parts, which have been herein described and illustrated in order to explain the nature of the invention, may be made by those skilled in the art within the principle and scope of the invention as expressed in the appended claims.

We claim:

1. A plasma antenna comprising:

a) an enclosed chamber;

b) a composition contained within the enclosed chamber capable of forming a plasma;

c) at least three energizing points capable of forming electromagnetic contact with the composition; and d) an energy source coupled to the at least three energizing points for developing at least one conductive path of plasma within the enclosed chamber, thereby forming the plasma antenna.

2. The plasma antenna of claim 1 further comprising a modifying mechanism to reconfigure the conductive path.

3. The plasma antenna of claim 1 wherein at least one conductive path is less than the length of the enclosed chamber.

4. The plasma antenna of claim 1 wherein the enclosed chamber is comprised of a non-conductive material.

5. The plasma antenna of claim 4 wherein the enclosed chamber is comprised of a dielectric material.

6. The plasma antenna of claim 1 wherein the enclosed chamber is an elongated tube.

7. The plasma antenna of claim 6 wherein the elongated tube is linear.

8. The plasma antenna of claim 6 wherein the elongated tube is looped.

9. The plasma antenna of claim 1 wherein the enclosed chamber is pronged.

10. The plasma antenna of claim 1 wherein the enclosed chamber is configured in a radiant shape.

11. The plasma antenna of claim 1 wherein the composition is a gas selected from the group consisting of neon, xenon, argon, krypton, hydrogen, helium, mercury vapor, and combinations thereof.

12. The plasma antenna of claim 1 having from 3 to 12 energizing points.

13. The plasma antenna of claim 1 wherein the conductive path is selectively formed between two energizing points.

14. The plasma antenna of claim 1 wherein any composition within the enclosed chamber that is not aligned with the path is not energized to form the plasma.

15. The plasma antenna of claim 1 wherein the conductive path is formed between three energizing points.

16. The plasma antenna of claim 1 wherein the conductive path is formed between four energizing points.

17. The plasma antenna of claim 2 wherein the modifying mechanism controls at least one of the at least three energizing points.

18. The plasma antenna of claim 17 wherein the modifying mechanism controls which of the at least three energizing points are activated.

19. The plasma antenna of claim 17 wherein the modifying mechanism controls the voltage applied to at least one of the at least three energizing points.

20. The plasma antenna of claim 2 wherein the modifying mechanism changes the composition to plasma.

21. The plasma antenna of claim 2 wherein the modifying mechanism alters the placement of energizing points.

22. The plasma antenna of claim 1 further comprising a signal generator electromagnetically coupled to the conductive path for transmission by the antenna.

23. The plasma antenna of claim 1 further comprising a signal receiver electromagnetically coupled to the conductive path for antenna reception.

24. The plasma antenna of claim 1 wherein at least two conductive paths of plasma are formed within the enclosed chamber such that multiple densities of plasma exist within the same enclosed chamber.

25. A method of generating a plasma antenna comprising:

a) defining a first conductive path of plasma within an enclosed chamber;

b) defining a second conductive path of plasma within the same enclosed chamber; and c) selectively energizing at least one of the first and second conductive paths, thereby forming the plasma antenna.

26. The method of claim 25 wherein the first conductive path is energized.

27. The method of claim 25 wherein the second conductive path is energized.

28. The method of claim 25 wherein both the first and second conductive paths are energized.

29. The method of claim 28 wherein multiple plasma densities exist within the enclosed chamber.

30. The method of claim 25 wherein the conductive path is less than the length of the enclosed chamber.

31. A method of generating a plasma antenna comprising:

a) applying at least three energizing points in electromagnetic communication with a composition capable of forming a plasma; and b) energizing at least one of the at least three energizing point such that a conductive path of plasma is formed that is capable of receiving or transmitting electromagnetic waves.

32. The method of claim 31 wherein the conductive path is formed by at least one energizing point and an energy sink.

33. The method of claim 31 wherein the conductive path is formed by two energizing points.

34. The method of claim 31 wherein the conductive path is formed by from 3 to 12 energizing points.

35. The method of claim 31 wherein the energizing points are energized by a common energy source.

36. The method of claim 31 wherein the energizing points are energized by at least two energy sources.

37. A method of reconfiguring a plasma antenna to alter the radiation pattern comprising:

a) providing a plasma antenna comprising:

i) an enclosed chamber, ii) a composition contained within the enclosed chamber capable of forming a plasma wherein at least a portion of the composition is energized to form a plasma conductive path, iii) at least three energizing points in electromagnetic contact with the composition, iv) an energy source in electromagnetic contact with the energizing points for energizing the composition and selectively forming at least one conductive path of plasma within the enclosed chamber, and v) a signal generator electromagnetically coupled to the plasma conductive path such that an emitting signal is transferred from the signal generator to the plasma conductive path; and b) altering the energizing point or combination of energizing points being energized by the energy source, thereby altering the plasma conductive path carrying the emitting signal.

38. A plasma antenna comprising:

a) an enclosed chamber;

b) a composition contained within the enclosed chamber capable of forming a plasma;

c) at least three energy source connectors configured for supplying electromagnetic energy to the composition; and d) an energy source coupled to the at least three energy source connectors for developing and maintaining at least one conductive path of plasma within the enclosed chamber, thereby forming the plasma antenna when the energy source and at least one of the at least three energy source connectors is activated.

* * * * *